US005981137A

United States Patent [19]

Meschter et al.

[11] Patent Number: 5,981,137

[45] **Date of Patent: *Nov. 9, 1999**

[54] PHOTOGRAPHIC FILM ASSEMBLAGES AND METHODS OF MAKING

[75] Inventors: John E. Meschter, Stow; Philip R. Norris, North Reading; Harry R. Parsons, Burlington, all of Mass.

[73] Assignee: Polaroid Corporation, Cambridge, Mass.

[ * ] Notice: This patent is subject to a terminal disclaimer.

[21] Appl. No.: 08/959,361

[22] Filed: Oct. 28, 1997

Related U.S. Application Data

[60] Provisional application No. 60/040,797, Mar. 17, 1997.

[51] Int. Cl.[6] ..... G03C 8/46; G03C 8/48

[52] U.S. Cl. ..... 430/208; 430/207; 430/498; 430/209; 396/364; 396/583

[58] Field of Search ..... 430/207, 208, 430/209, 498; 396/364

[56] References Cited

U.S. PATENT DOCUMENTS

| | | | |
|---|---|---|---|
| 3,636,845 | 1/1972 | Harvey | 95/13 |
| 3,767,405 | 10/1973 | Harvey | 430/209 |
| 3,933,555 | 1/1976 | Downey | 156/155 |
| 4,042,395 | 8/1977 | Tone et al. | 430/209 |
| 4,556,631 | 12/1985 | Sato et al. | 430/209 |
| 4,824,761 | 4/1989 | Sturgis et al. | 430/209 |
| 5,023,163 | 6/1991 | Simizu et al. | 430/209 |

*Primary Examiner*—Richard L. Schilling
*Attorney, Agent, or Firm*—Leslie Payne

[57] ABSTRACT

An improved self-developing film unit comprising: a processing fluid supply including a rupturable reservoir of processing fluid; an image recording assembly of the self-developing type including first and second overlying layers one of which is exposable to form a latent photographic image, and a spacer connected to and between the first and second layers for providing a processing space therebetween for allowing processing fluid to pass therethrough; a fluid trap at a trailing end portion of the film unit for collecting excess processing fluid traveling through the processing space; a first fluid-tight coupling device including a fluid passage for fluidically coupling the reservoir to a leading end of the processing space for allowing processing fluid from a ruptured reservoir to be introduced into the processing space and initiate processing of the latent image; and, second fluid-tight coupling device including a fluid passage for fluidically coupling a trailing end of the processing space with the trap for allowing processing fluid to enter into the trap; the image recording assembly comprises a photosensitive layer, an image receiving layer in overlying and coextensive relationship to the photosensitive layer; the image receiving layer and the photosensitive layer being of the integral diffusion transfer type; and, the spacer comprises a pair of spaced apart and generally parallel elongated rails coextensive with and adjacent opposed marginal edges of the layers.

9 Claims, 10 Drawing Sheets

PHOTOGRAPHIC FILM ASSEMBLAGES AND METHODS OF MAKING

This application claims benefit of Provisional application Ser. No. 60/040,797 filed Mar. 17, 1997.

CROSS-REFERENCE TO RELATED APPLICATIONS

The present application is related to copending non-provisional U.S. patent application Ser. No. 08/808,040, entitled "Photographic Apparatus and Method"; filed in the United States Patent and Trademark Office on Mar. 4, 1997; and, provisional U.S. patent application Ser. No. 60/040,254, entitled "Film Assemblage"; filed in the United States Patent and Trademark Office on Mar. 10, 1997.

BACKGROUND OF THE INVENTION

The present invention relates generally to photographic film assemblages and manufacturing processes, and, in particular, to photographic film assemblages of the self-developing type and methods of making.

Heretofore, a wide variety of film assemblages of the instant developing type as well as attendant methods of manufacturing thereof have been proposed. Despite the significant variety of such assemblages and methods of manufacture, efforts have been undertaken to provide for even more simplified film assemblages of the self-developing type so that they can be inexpensively and reliably made; thereby resulting in overall low-cost film assemblages. It will be also be appreciated that even savings of a few cents in the manufacture individual film frames can be quite considerable given the extremely high volumes of film which are typically commercially produced.

SUMMARY OF THE INVENTION

According to the present invention there is provided an improved self-developing film unit. Provision is made for: a processing fluid supply assembly including a rupturable reservoir of processing fluid at a leading end portion of the unit; a self-developing image recording assembly including first and second overlying layers, one of the layers is exposable to form a latent photographic image, and a spacer assembly is connected to and between the first and second layers for providing a processing space therebetween which allows processing fluid to pass therethrough; fluid trap assembly at a trailing end portion of the film unit for collecting excess processing fluid traveling through the processing space; first fluid-tight coupling assembly including a fluid passage for fluidically coupling the reservoir to a leading end of the processing space for allowing processing fluid from a ruptured reservoir to be introduced into the processing space and initiate processing of the latent image; and, second fluid-tight coupling assembly including a fluid passage for fluidically coupling a trailing end of the processing space with the trap assembly for allowing processing fluid to enter into the trap assembly. The first coupling assembly has one end portion sealably secured to an exterior surface of the reservoir and a second end portion sealably secured to an exterior surface of a leading end portion of the image recording assembly. The second coupling assembly has an end portion sealably secured to and about the trailing end portion of the image recording assembly and an opposite end portion sealably secured to an exterior surface of the trap assembly.

In an illustrated embodiment the image recording assembly comprises a photosensitive layer, and an image receiving layer in overlying and coextensive relationship to the photosensitive layer. The image receiving layer and the photosensitive layer is preferably of the integral diffusion transfer type; and, the spacer assembly means comprises a pair of spaced apart and generally parallel elongated rails coextensive with and adjacent opposed marginal edges of the layers. In such embodiment, provision is made wherein each of the first and second fluid-tight coupling assembly is made of a pair of resiliently flexible sheets which are sealably joined together to define the respective fluid passages and which are made of a foldable and rollable material to thereby facilitate folding and unfolding thereof as well as permit rolling action thereof during unfolding of the film unit.

In another illustrated embodiment, provision is made for a braking assembly thereon protruding from the film unit and associated with the reservoir and is engageable with a stop in an imaging apparatus, thereby brake linear advancement of the film unit. In this illustrated embodiment the braking means includes a filament extending generally parallel to the reservoir.

In another illustrated embodiment provision is made for having a plurality of film units being interconnected together in longitudinally extending end-to-end relationship to each other with a leading end portion of the reservoir of one film unit being juxtaposed to a trailing end portion of an adjacent film unit; and, means separably interconnecting each linear pair of film units connected in end-to-end relationship. In another illustrated embodiment, provision is made for the interconnecting means to include an interconnecting sheet forming a portion of the first coupling means at one end and a second coupling means at the other end.

Provision is also made to methods of forming a self-developing film unit of the above type as well as an assemblage thereof.

It is, therefore, an object of the present invention to provide for new and improved film assemblages and methodologies for manufacturing film assemblages of the self-developing type which are simple and easy in operation and yet result in relatively high yields of reliable and versatile film assemblages.

It is also another object of the present invention to provide for new and improved film assemblages which can be made in a variety of ways using a variety of materials without making resultant film assemblages incompatible to the camera for which they are intended to operate. It being understood that for the most part if a film assemblage is constructed somewhat differently then the associated camera would typically have to be redesigned. Accordingly, the present invention allows different film constructions to be used in combination with the same camera without requiring redesign of the camera.

The above and other objects and scope of the present invention will become apparent following reading a detailed description thereof when taken in conjunction with the accompanying drawings in which like reference numerals indicate like structure throughout the several views.

DETAILED DESCRIPTION

Reference is made to the aforenoted copending provisional patent application Ser. No. 60/040,254, U.S. Patent and Trademark Office on Mar. 10, 1997, as well as copending non-provisional U.S. patent application Ser. No. 08/808,040 entitled "Photographic Apparatus and Method"; filed in the United States Patent and Trademark Office on Mar. 4, 1997; which applications are incorporated herein by reference and made a part hereof.

Figure 1:
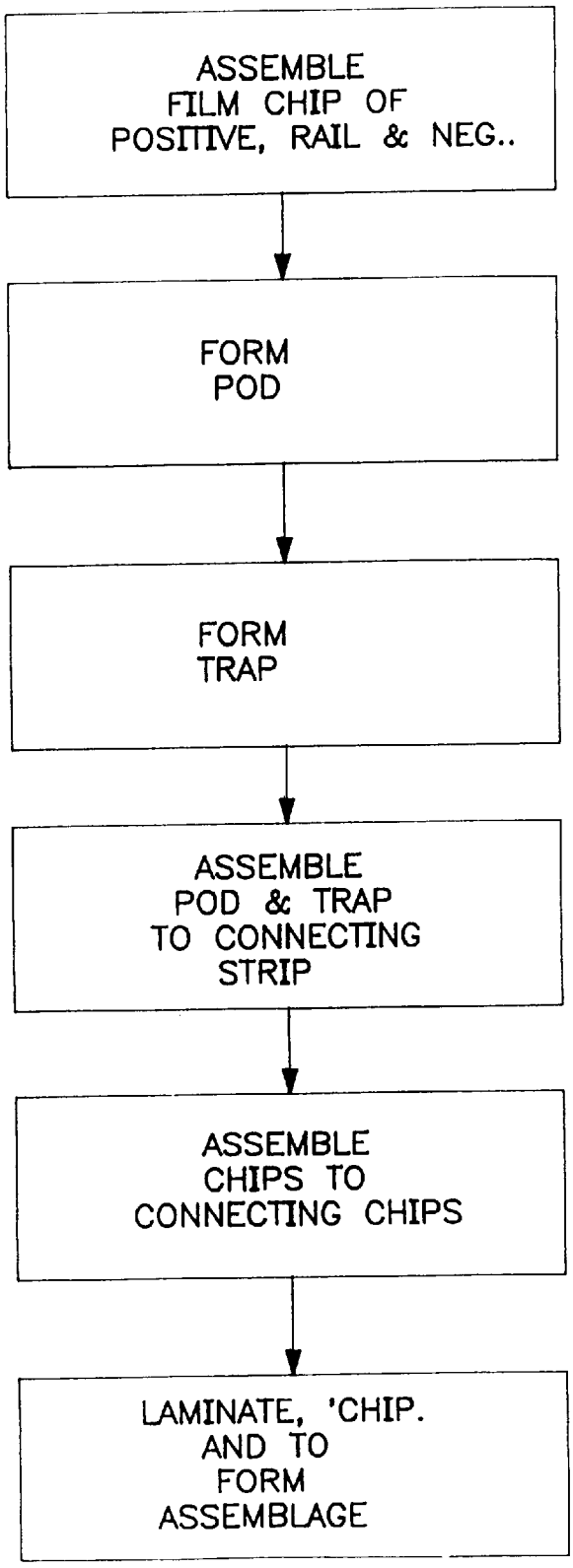
FIG. 1 is a block diagram of one of the preferred methods of manufacturing film in accordance with the present invention.
Figure 2:
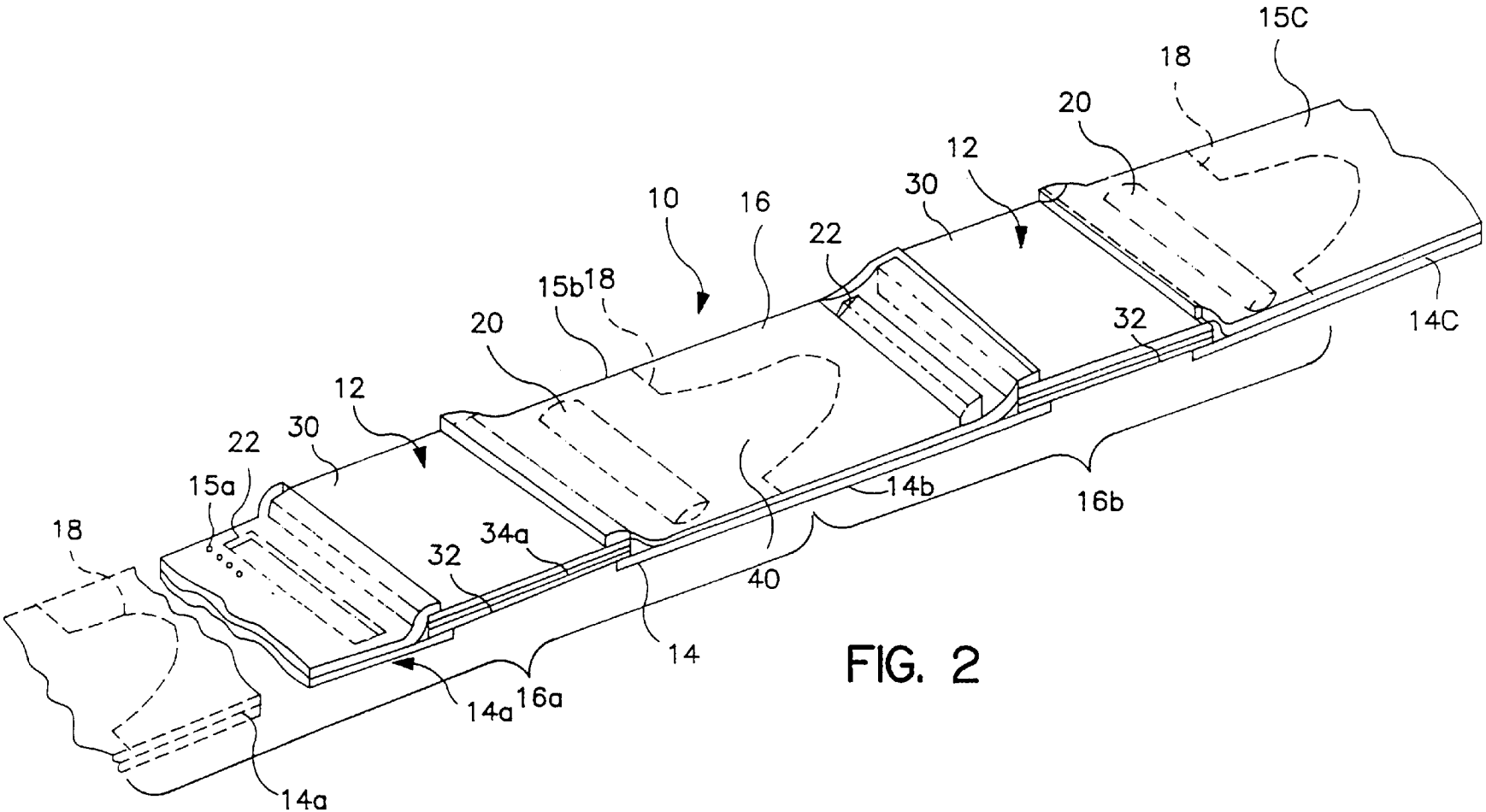
FIG. 2 is a perspective view of the film assemblage which can be made in accordance with the present invention.

In FIG. 2, a portion of a longitudinally extending photographic film assemblage 10 is illustrated as comprising a plurality of alternately spaced self-developing film units 12 of the integral type; but as will be described, the film units can be made of the self-developing peel-apart type. Coextensive pairs of connecting strips 14*a–c* and covering strips 15*a–c*; respectively, are connected in an alternating linear arrangement to each of the film units 12 so as to form a continuous longitudinal film assemblage. The film assemblage 10 is conveniently subdivided into separable and individual image units or frames 16*a, b* extending lengthwise from a weakened or frangible portion 18 on one pair of the pairs of connecting strips 14*b* to the equivalent portion 18 on the adjacent pair of pairs of connecting strips 14*a*. For some embodiments, ten or twelve frames can be made. In fact several hundred frames can be connected in series. As will be discussed below, the weakened or frangible portions 18, preferably represent structurally weakened sections intended to permit easy separation of successive individual ones of the frames 16*a,b*. FIG. 1 illustrates one sequence in the manufacture of a film assemblage of the present invention.

Essentially, each of the film frames 16*a, b* comprises one of the film units 12, a rupturable container or pod 20 containing processing liquid being located adjacent a leading edge of the film unit 12 and, a trap 22 adjacent the trailing edge of the film unit 12. The trap 22 is adapted to collect excess processing liquid from the ruptured pod which liquid is not consumed during processing of a film unit 12. Both the rupturable pod or container 20 and the trap 22 are secured as by lamination to pairs of connecting and covering strips in a variety of sequence steps by, for example, hot-melt type adhesives; as will be described. A hot-melt laminator will serve to secure the pod and the trap to the connecting and covering sheets as desired. The cooperating pairs of connecting and covering strips can be made of a variety of materials and in this embodiment can be a masking material of the type used in the self-developing art.

Reference is made to the sandwich construction of the individual film units. Each is identical and therefore a description of one will suffice for all. Essentially included in the sandwich construction is a layer or sheet of an image-receiving member 30, and generally coextensive in superposed relationship therewith is a layer or sheet of a photosensitive member 32, as well as laminated therebetween is a pair of the longitudinally extending rails 34*a,b* that are spaced along the marginal edges of the film unit. Although not illustrated, the film unit 12 can also be of the peel-apart type, wherein the respective members 30 and 32 can be separated after processing. In one example of a peel-apart type film, the photosensitive member can be made of the so-called "Excedrin" type, wherein light is transmitted through it to a generally coextensive and superposable cover sheet having a pair of side rails thereto. Such covering sheet is releasably laminated to the photosensitive member. In such an embodiment the covering sheet and rails would take the place of the member 30 and rails 34*a,b*, and can be removed from the superposed relationship after the image has developed. Other peel-apart configurations are contemplated.

Figure 3A:
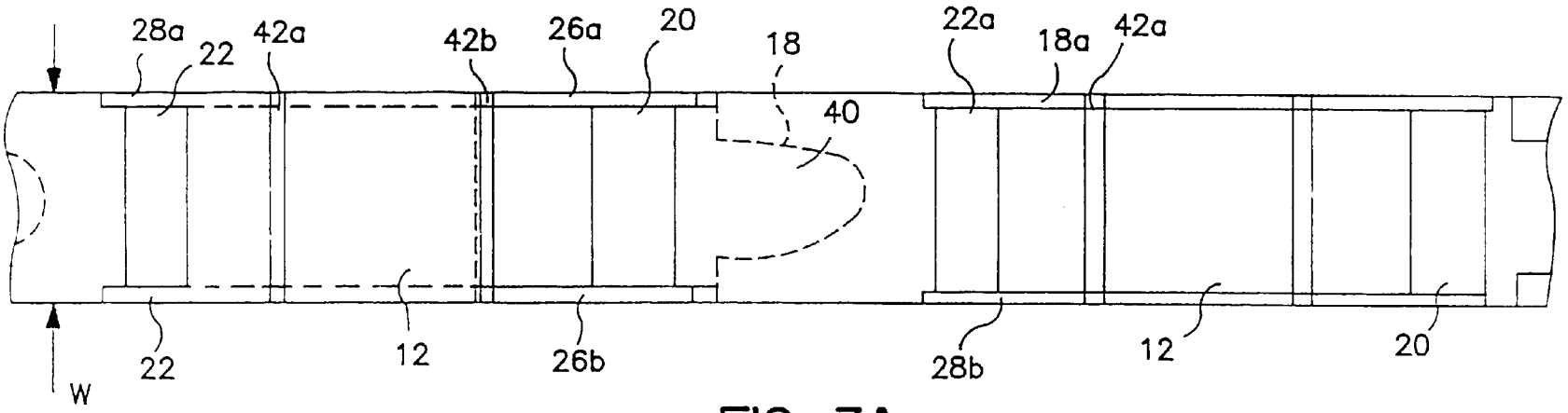
FIG. 3*a* a top plan view of the film assemblage of the invention.
Figure 3B:
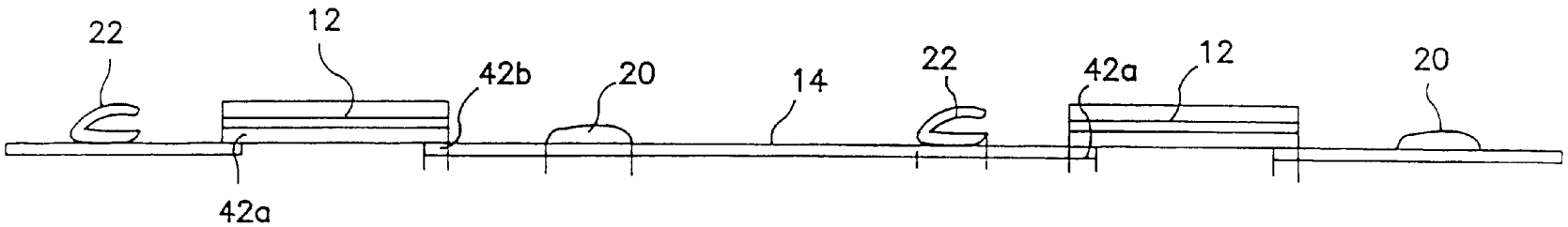
FIG. 3*b* a side view of the film assemblage of FIG. 3*a* during assembly.
Figure 3C:
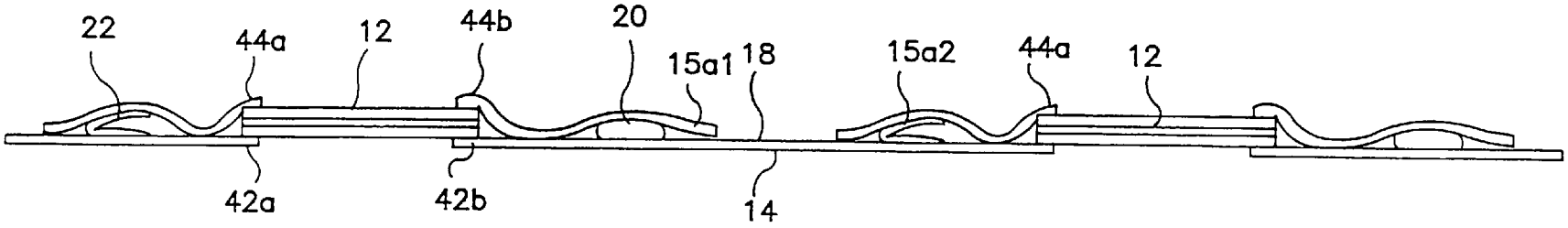
FIG. 3*c* is a side view of an embodiment of the film assemblage of FIG. 3*a* after assembly.
Figure 3D:
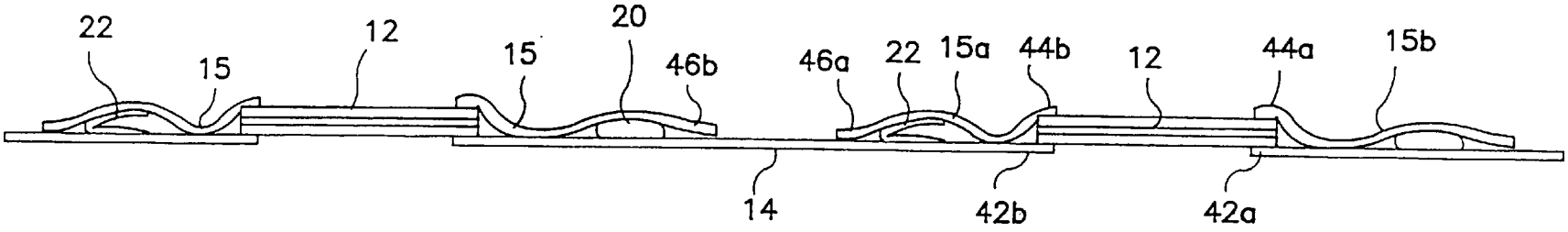
FIG. 3*d* is a side view of another embodiment of the film assemblage of FIG. 3*a* after assembly.
Figure 4:
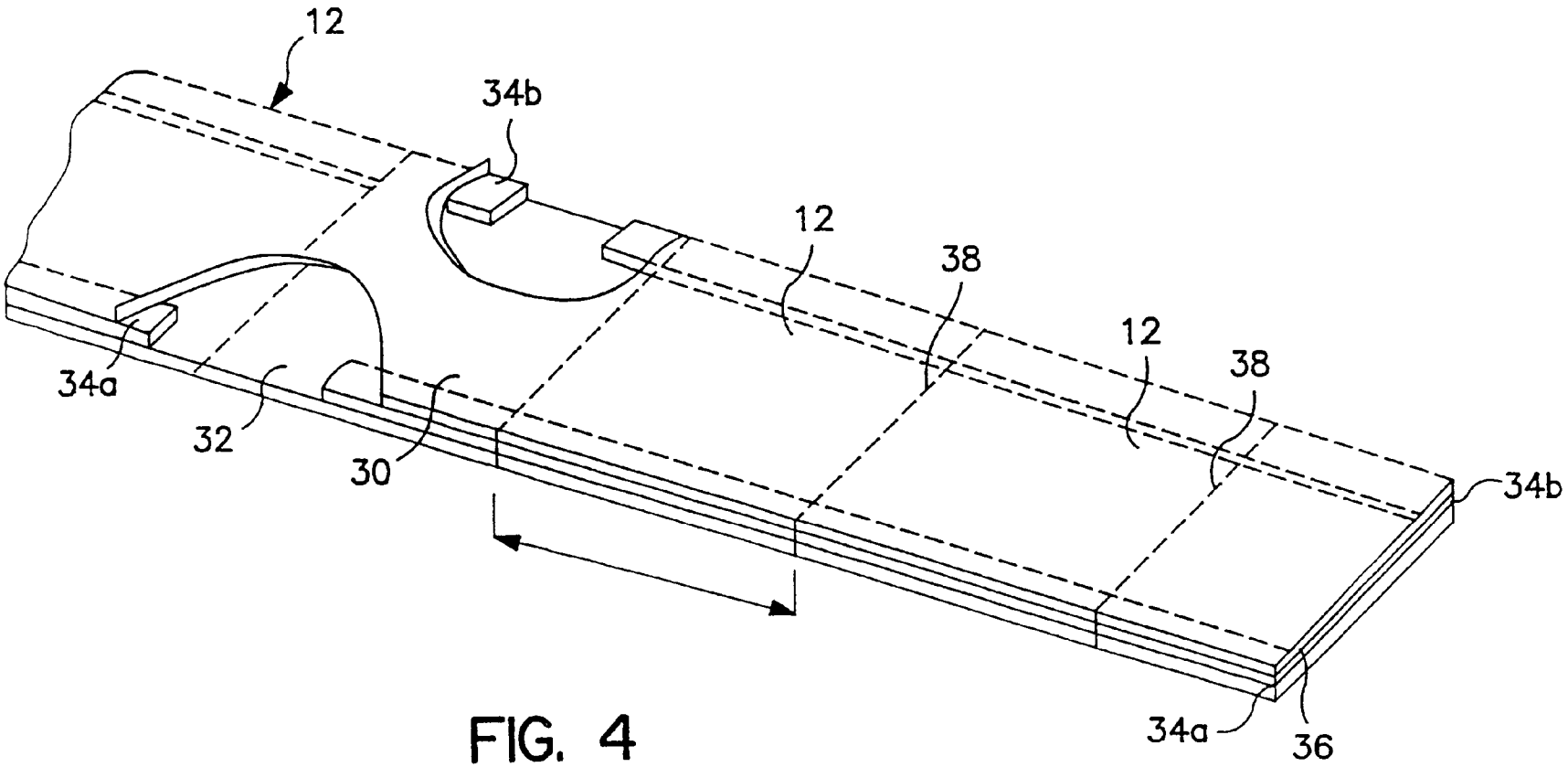
FIG. 4 is a perspective, partially broken out view of the construction of the integral film strip before separation into individual film units used for making the film assemblage of the invention.

Reference is made to FIGS. 2–4. One method of manufacturing the above film assemblage of the integral type includes employing a roll of a laminated film sandwich construction. The rolled sandwich construction when cut generally transversely defines the individual film units 12. The web width of the sandwich can be varied as well as the spacing of the transverse cuts, thereby allowing for the formation of film units of different sizes and aspect ratios. Thus, the illustrated configuration of the film unit is representative of many different variations that are possible by reason of the sandwich construction.

To form the rolled laminated sandwich construction; a strip of photosensitive sheet material 30 and a strip of the image-receiving sheet material 32 are brought into intimate engagement with each other in a coextensive relationship by being fed into a nip of a pair of counterrotating laminating rollers of a rotary feeder (not shown). Fed contemporaneously therewith and along opposite longitudinal edges is a pair of strips of rail material; each coming from an appropriate roll thereof. The rails have the appropriate thickness for the particular film assemblage they are to be used with. These rails, as noted, are sandwiched between the sheets 30 and 32 so as to be positioned along the opposing longitudinal edges thereof. Conditions of heat and pressure are selected for a time period which will ensure the desired laminations. The pressure and time are selected in a known manner in order to heat the heat sensitive materials to achieve the desired bonding. For instance, the rollers can both be steel, both rubber covered or one of rubber coating and the other of steel. Thereafter, the appropriately laminated sheets are, preferably wound on a spool for providing a film supply roll. If the film supply 18 after lamination is to be wound onto a spool, then the radius of that spool and the wind-up tension should be chosen equally carefully so as to not cause excessive bending of the composite sandwich; especially those mutually facing portions thereof located between the two rails 34*a*, 34*b*.

It is important to maintain proper tension within the individual sheets and rails and between the sheets and rails, respectively, when the sheets and rails are conveyed from the rolls to the nip. Since the film supply 18 is a composite structure, uneven tension between the image-receiving member 30 and the photosensitive member 32 during lamination can lead to curling of the film supply 18 after lamination. As an example, if the tension in the supply of image-receiving member 30 is higher than the tension of photosensitive member 32 before the nip, then image-receiving member 30 is stretched and will relax, i.e. contract, after lamination. The film supply 18 will therefore curl, with photosensitive member 32 forming a convex surface and image-receiving member 30 forming a concave surface.

As noted above, heat from the lamination process made adversely affect the properties of the photographic sheet and possibly other materials or components, too. The rollers may therefore be made in a way that the roller(s) do(es) not contact the surface of the image-receiving member 30 and/or photosensitive member 32 expect for the lateral marginal edges of the film supply 18 including the rail sections 34*a*, 34*b*. This can be accomplished by a longitudinally extending, radial recess in the roller(s) which may be filled with a material of low thermal conductivity, such as a rubber compound. It is apparent that this concept can be applied to other film structures aside from the embodiment depicted in FIG. 4.

Rail material generally comprises a PET base which has disposed thereon either thin layers of another material, preferably a composite such as paper/fiber, or a preferably liquid coating providing the desired thickness when dry. Subsequently, an adhesive which melts through application of heat is applied to both sides of the rails. Activation temperatures for the adhesive vary depending on several factors including the specific application. As noted to facilitate the sensitometric matching the thickness of the rail sections are adjusted. One manner of achieving this is to have one of the layers with a thickness that is somewhat less than the optimum rail thickness, and the second layer is thinner and can have its thickness varied in accordance with the requirements to obtain correct sensitometry.

One of the advantages of the foregoing sandwich relationship is that the sensitometric relationship of the photosensitive strip and the image receiving strip can be adjusted quite easily by appropriately adjusting the thickness of the rail in a known manner; whereby the thickness of the gap between the image-receiving member and the photosensitive member can be set by the adjusting the thickness of the rails. Because of the requirements to sensitometrically match the image-receiving member 30 and photosensitive member 32 to each other and to the rail sections 34*a*, 34*b*, the film supply 18, in various embodiments to be discussed hereinafter, are preferably pre-assembled in a factory where their sensitometric properties can be measured and, if necessary, adjusted.

While the foregoing embodiment discloses a preference for rails, the present invention contemplates that no rails need be present between the image-receiving member 30 and photosensitive member 32. The achievement of the noted mechanical gapping desired for spreading would then be achieved by stepped rollers. However with the presence of sandwiched rails, the film unit has no need for use with relatively expensive stepped rollers. In fact, relatively inexpensive generally cylindrical spread rollers may be used instead.

Referring now to FIG. 4, there is shown a segment of a portion of the film unit. Individual film units 12 are subsequently severed, for example cut with a hand cutter at assembly or by a high speed mechanical chopper. Other cutting devices, such as a laser or the like can be used. The two members 30, 32 and the rail sections 34*a*, 34*b* define a laterally opening 36 therebetween for providing a passage of the processing liquid. The image-receiving member 30 and an photosensitive member 32 of each individual film unit 12 are preferably coextensive, and the rail sections are most preferably coextensive with the marginal edges over the entire length of the film unit 12. The film units 12 therefore do not require additional processing after separation. Although the separation cuts are preferably perpendicular to the film surface, the cuts may also be angled in order to provide less volume for any residual processing liquid left in the space proximate to the leading and trailing edges, respectively, of the film unit 12.

Figure 5:
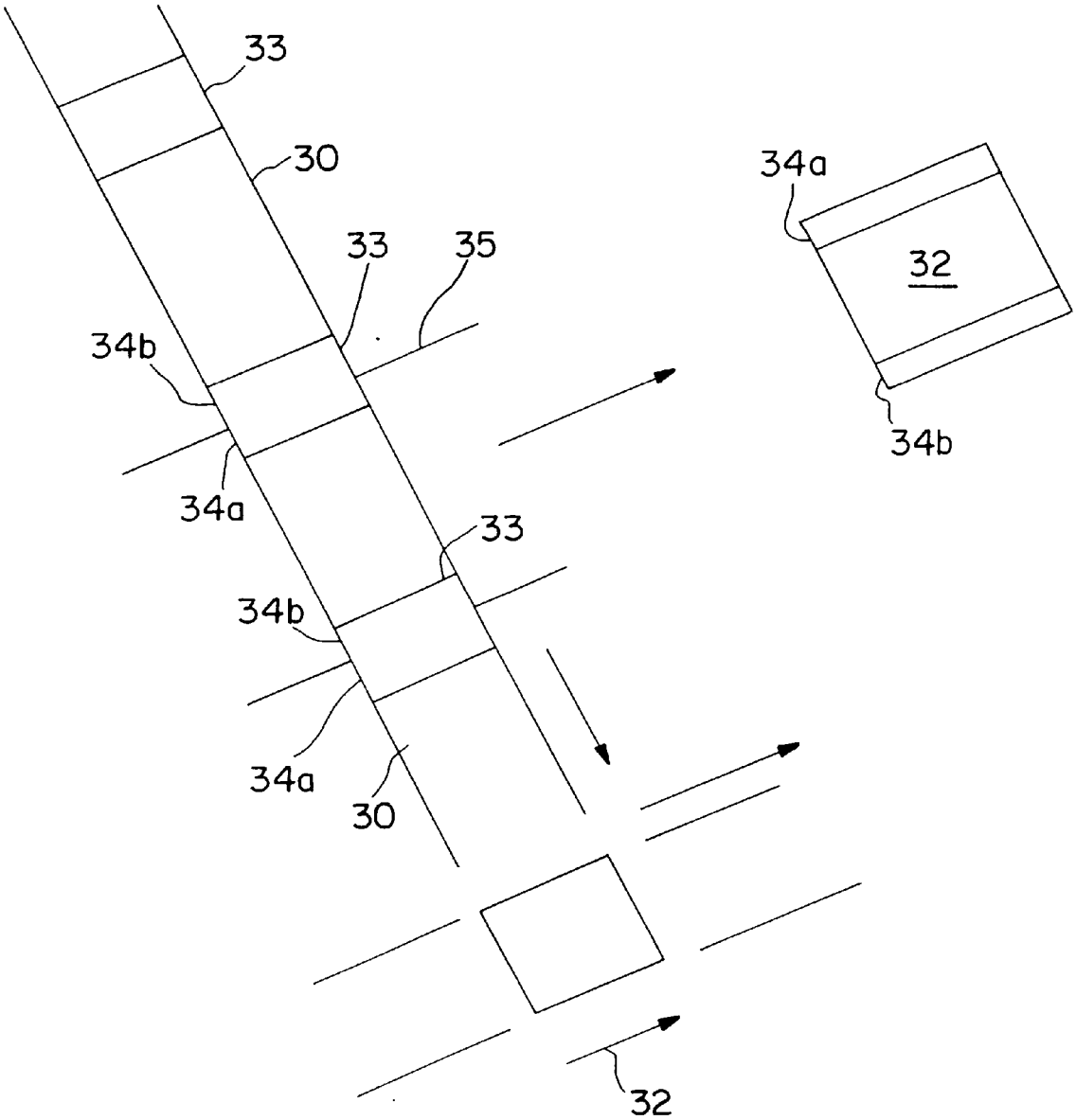
FIG. 5 is schematic version of the one manner of making the film.

Although the film units can be cut from a rolled laminated sandwich construction, other methods of film unit constructions are possible. For instance, reference is made to FIG. 5 for illustrating another one of the preferred methods of construction. As depicted, a strip of photosensitive material 32 advances along a first path in the direction of the arrows; and, a strip of image-receiving material 30 advances along a second path in the direction of the arrows and could travel at right angles to the negative. In such a method, the image-receiving strip would have secured thereto, as by known techniques and at appropriately spaced intervals, transverse strips of rails 33 made of the appropriate rail material. Each of the rails 33 could have a width which would be at least double the width of a desired film unit side rail. Each of the rails 33 could be cut medially as along a cutting line indicated by reference numeral 35 so as to form segments of two rails 34*a*, 34*b*. The result of the cutting action is the formation of individual sheets of image-receiving members having a pair of appropriately spaced side rails. Thereafter, an appropriately dimensioned photosensitive member 32 can be cut and adhered or secured, as by lamination, to the side rails 34*a*, 34*b*; thereby forming a corresponding film unit 12.

Figure 6:
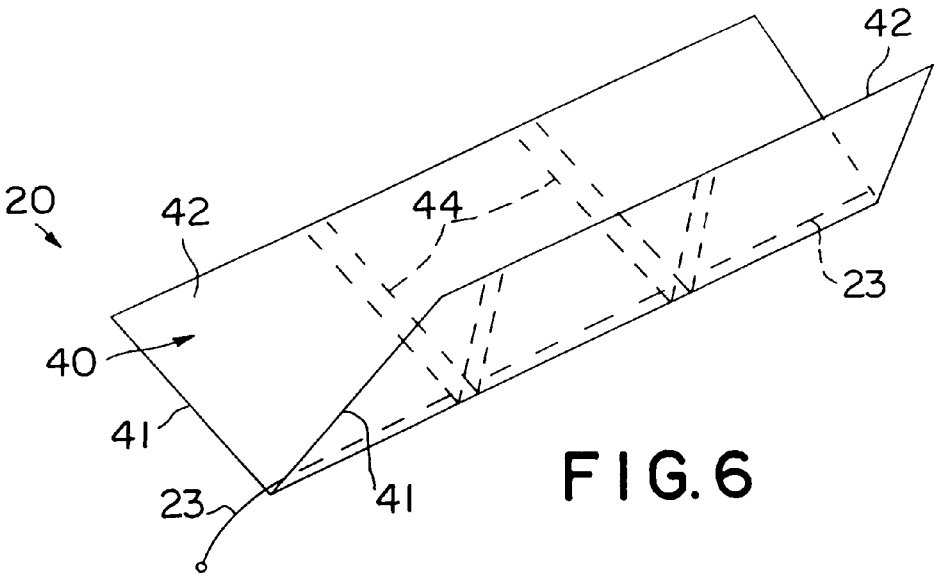
FIGS. 6 & 7 illustrate perspective and end views of one version of forming a pod.
Figure 7:
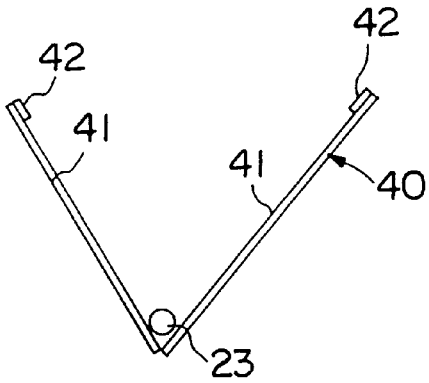
Figure 8:
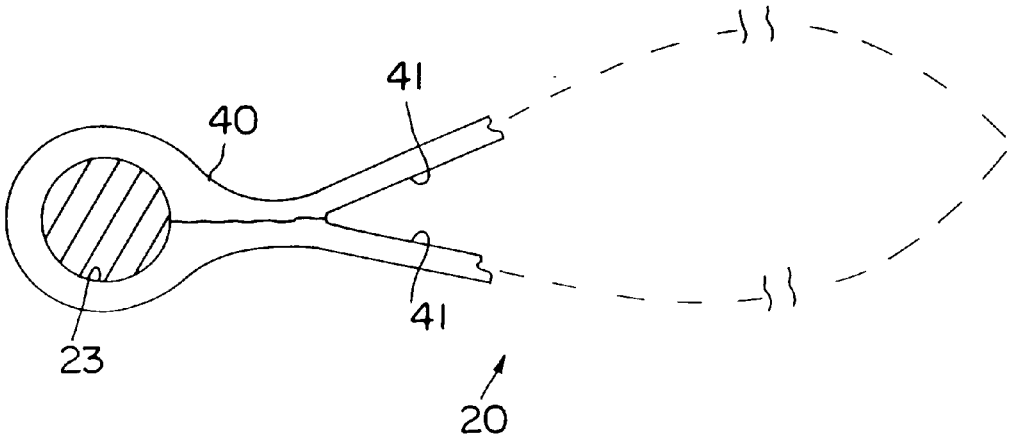
FIG. 8 illustrates one version of a portion of a pod made according to the invention.

After having described some of the methods for manufacturing the film units, reference is now made to FIGS. 2–4 taken together with FIGS. 6–8 for describing the pod 20 and its attachment to film assemblage 10. It will be understood that a wide variety of pod constructions can be used in the film assemblage which pods can be made by known pod making methods and hence a detailed description thereof is not needed. In this embodiment, the pod 20 includes a composite sheet structure 40 made of a vinyl layer on the inside surface, an aluminum middle layer and paper outer layer. The pod sheet 40 is medially folded. A puddle of liquid reagent is added to a resultant trough and the top edges 42 of both folds are sealed as well as the end edges thereby achieving a pod of predetermined length. The top edge seal is of a predetermined relatively weaker bond than the other seals so that the pod may rupture therealong and allow distribution of the processing fluid. The pod is cut to proper longitudinal dimensions, i.e. matching the width of the desired image which depends on the film format used, filled with known processing liquid and sealed liquid-tight by lamination along the lateral edges and the rupturing edge opposite to the non-rupturing side of the pod, not necessarily in that order. If desired each pod can be transversely sealed along seal lines 44, whereby there is a vinyl-to-vinyl contact to form pod subcompartments. Formation of such transverse seals is achieved by heat bonding the vinyl inner layer of opposing flaps of the pod together. Later the seals, along these seal lines, can be cut in order to form pods of a smaller predetermined length. However, the present embodiment differs from known pod constructions in that it includes a string 23 positioned along the bottom of the V-shaped trough (see FIG. 6); and as will be described serves as an arresting means for pod advancement. The resistance which is provided in this regard provides a reaction force that is higher than the pulling force on the film unit thereby allowing the frangible sections 18 to fracture and thus separate. However with the string construction, provision is for a resistance which reacts with the rollers in the camera directly and not the walls of the pod, per se. In addition, there is a secondary function in that the string creates an indexing protrusion or stop which serves to properly locate the next successive film unit of the strip at a desired focal cone in the camera. To form this string stop, the string 23 is placed in the bottom of the trough and a portion of the trough immediately above the string is laminated together around the string. In this regard, the vinyl surface on the inside of one leg 41 is laminated to the vinyl surface on the inside surface of the other leg 41. Thereafter, the pod is filled and sealed in a known manner as described above. The string therefore provides a bump which initially engages the rollers and therefor lessens the danger of premature pod rupture because it separates unwanted pulling forces acting directly in terms of rupturing the pod.

Although a string is disclosed other materials and geometrically arranged cross-sections are contemplated. Of course, the ends of the string have been removed following insertion in the pod. It is also contemplated that other similar techniques can by used in the formation of such braking protrusions; such as molding or placing a structure on the connecting members or by inserting a material between the connecting and covering strips. The present invention also contemplates having a pod which can be made of a variety of materials which can have a variety of shapes. In addition, the pod can include structure such as metal or be made of materials which serve to resist being cut as by scissors or the like in order to prevent undesired rupture of the pods by cutting. In addition, it is contemplated that instead of protrusions other equivalent braking structure can be used.

Figure 9:
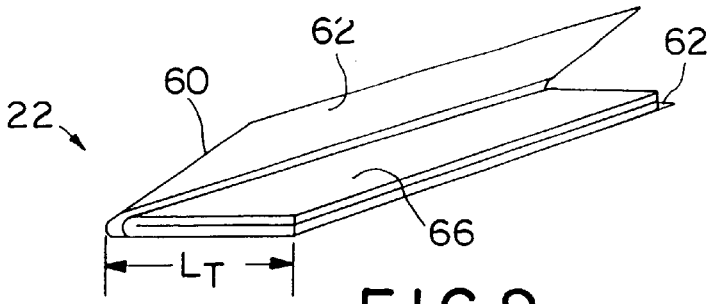
FIG. 9 illustrates one version of a trap.
Figure 10:
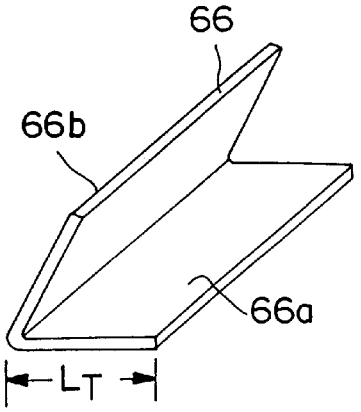
FIG. 10 illustrates another version of a trap.

Reference is made to FIGS. 9 & 10 for illustrating one of the trap embodiments. The various embodiments have in common that the individual traps disposed on the film assemblage 10 are separated, for example cut, to the desired length from a preferably continuous tape which is preassembled. The trap construction is formed in the manner indicated in the first noted copending application and therefore a detailed description thereof is not needed. It will be appreciated that the trap serves generally to collect the excess processing fluid as well as neutralize it. In addition, the trap serves to spread the processing rollers apart so that the rollers do not continue to force the fluid to burst the trap seal and thereby travel undesirably to the next unit. In this embodiment, there is provided a trap mask 60 having a generally V-shaped configuration which has one of the folds 62 heat sealed at the bottom to one of the connecting sheets and may have the other fold 64 heat sealed to the top covering sheet. A strip 66 of known trap material is heat sealed to the inside surface of the fold 62. This trap construction is fed across the full width of the connecting strips. Another version of a trap is shown in FIG. 10, wherein the strip 66 of trap material is medially folded and both folds 66*a, b* are appropriately secured to the connecting and covering sheets; respectively, as by lamination of the type disclosed.

After having explained the formation of the pods and traps, an explanation of the cooperating pairs of connecting and covering strips will be presented. In this regard, reference is made back to FIGS. 2–3. As noted, the cooperating strips define a liquid-tight fluid passageway between the rupturable container 20 and the leading edge of the film unit 12, as well as between the trailing edge of the film unit 12 and the trap 22. The covering strips are generally coextensive in width with and are disposed on top of the connecting strips. The two strips are secured at their respective ends to the leading and trailing edges, respectively, of the film unit 12 by, for example, appropriate hot-melt adhesives. Furthermore, the pairs of connecting and covering strips are secured and sealed fluid-tight along the side marginal portions 26*a*, 26*b* proximate to the rupturable container 20 and along the side marginal portions 28*a*, 28*b* proximate to the trap 22. In the region between the rupturable container 20 and the trap 22, the pairs of connecting strips and the covering strips are affixed, such as by adhesives or by heat-sealing, to each other in a manner to seal in a liquid-tight manner the rupturable container 20 and trap 22 from the environment, for example by a hot-melt laminator. The pairs of connecting and covering strips are secured in a liquid-tight manner, for example by heat sealing, along respective lateral portions 42*a*, 42*b* to the film units 12 end-to-end in an alternating arrangement. In addition, an essentially "zero gap" remains between the pairs of connecting strips 14 and the covering strip 15. These zone of zero gap is sufficiently dimensioned that it will after processing contain only insignificant amounts of residual processing liquid. The zone is capable of also accumulating any excess reagent which might otherwise "blows back" into the openings 36 of the film unit 12 and cause undesirable image artifacts. The zone also allows easy flexing of the film assemblage. Another advantage is that the relatively stiffer sections of the image unit 12, i.e. the sections where the rupturable container 20 and the trap 22 are secured to the pairs of connecting strips, can be withdrawn from the cooperating camera without bending whereas all other sections of the pairs of strips are easily flexed.

Referring first to FIG. 3*c*, in a first embodiment, there is provided one covering strip 15 for each pairs of connecting and covering strips. The covering strip 15 has substantially the same length and the same width as the pairs of connecting strips 14 and is placed in coextensive registration with and secured to the pairs of connecting strips 14 in the manner described above, e.g. by sealing along marginal edges 26*a*, 26*b*, 28*a*, 28*b* and in the region between the rupturable container 20 and the trap 22. Instead of using a covering strip separate from the connecting strips for providing the fluid passageway, a single connecting strip having an enlarged width can be employed which width is medially foldable lengthwise so that there is only one lamination along the mutually adjoining edges. The fluid passageways may also be made of a single member having an appropriately formed lumen therethrough in order to carry the processing fluid. Of course the film units would have to be inserted into the opposing ends of the lumen.

As previously noted, the film assemblage 10 is preferably provided with structurally weakened sections 18. The sections 18 are weakened by, for example, perforations for facilitating separation of adjacent image units 16*a, b*, etc. The perforations preferably define a tab 40, as is illustrated, which is useful for pulling a leading image unit out of a cooperating camera (not shown), thus facilitating manual processing and allowing an inexpensive camera design. The tab 40 remains after the separation at a preceding image unit separated by pulling. It would, however, be apparent to those skilled in the art that other method suitable for separating successive image units 16, for example notches along the marginal lateral edges or external cutters, could also be employed and the existence of a tab and the location and shape thereof depicted in the figures should be only understood as an exemplary preferred embodiment of the invention.

In another embodiment of the invention, depicted in FIG. 3*d*, the contiguous covering strip 15 of FIG. 3*c* is replaced by a first covering strip 15*a*1 covering and sealing the region extending over the rupturable container 20 and the leading edge of the film unit 12, with a preferably liquid-tight seal along the edge 46*b*, and by a second covering strip 15*b*1 covering and sealing the region extending over the trap 22 and the trailing edge of the film unit 12, with a preferably liquid-tight seal along the edge 46*a*.

During processing of the image units 16*a, b*, etc. in a cooperating camera (not shown), appropriate spreading rollers (also not shown) rupture the rupturable container 20 and spread the processing liquid from the rupturable container 20 to the leading edge of film unit 12, and into the opening 36 and through the film unit 12. Any excess processing liquid exits at the trailing edge of film unit 12 and travels to the trap 22.

It will be appreciated that the preferred methods for attaching and/or securing and/or sealing the various elements and components to each other is by heat or pressure lamination using adhesives responsive to heat and/or pressure, also other methods, such as gluing or welding, may also be contemplated. Such attachment methods are well known in the art. As noted above, the preferred process used for joining the various components of the film assemblage 10 is through an adhesive and the application of pressure and/or heat; this process is referred to as lamination. The most preferred lamination method is by using a rotary laminator wherein the components to be laminated are brought together in superposed registration between the nips of heated rollers, with pressure applied between the rollers. In the present invention, photosensitive sheet, a plurality of rail sheets in form of strips, and image receiving sheet, in that order, are taken from separate supply rolls and joined by bringing them together into the nip of a pair of driven rolls. Suitable guide and tensioning means may be arranged in a conventional manner to bring the sheets together into registry. The rollers are adapted to provide a suitable pressure and temperature and uniformity of pressure and temperature across the rollers for ensuring proper melting of the hot-melt adhesive disposed on the exposed surfaces of the rail material.

Figure 11:
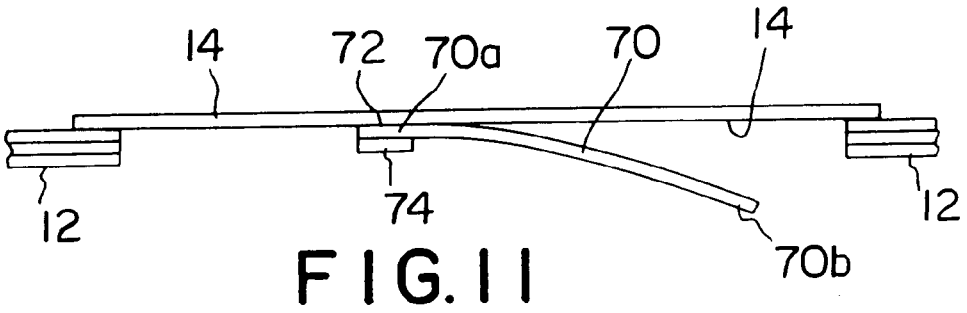
FIGS. 11 and 11*a* illustrate another version of making a trap.
Figure 11A:
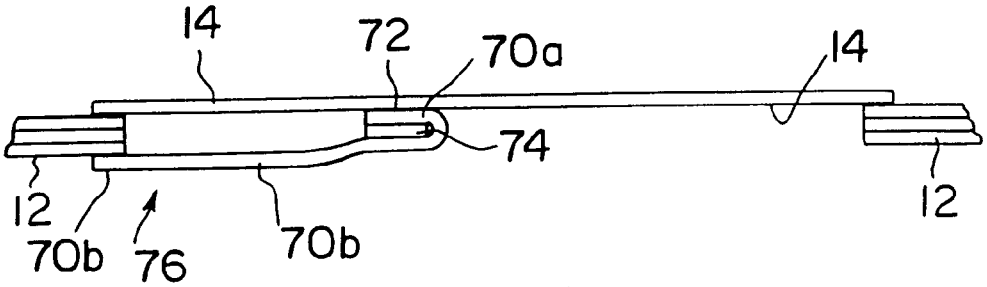

Reference is made to FIGS. 11 and 11*a* for illustrating another trap configuration of the present invention as well as method of making. As illustrated, the connecting strip 14 has a trap mask 70 with its proximal end 70*a* adhesively attached at 72 to an intermediate portion of the connecting strip as at 72. A distal end 70*b* of the trap mask is folded over a strip 74 of trap material and secured to a transverse edge of a film unit 12 thereby forming a trap 76. The lateral ends of the trap mask are then laminated to the side edges of the connecting strip so as to define a self-contained trap.

Figure 11B:
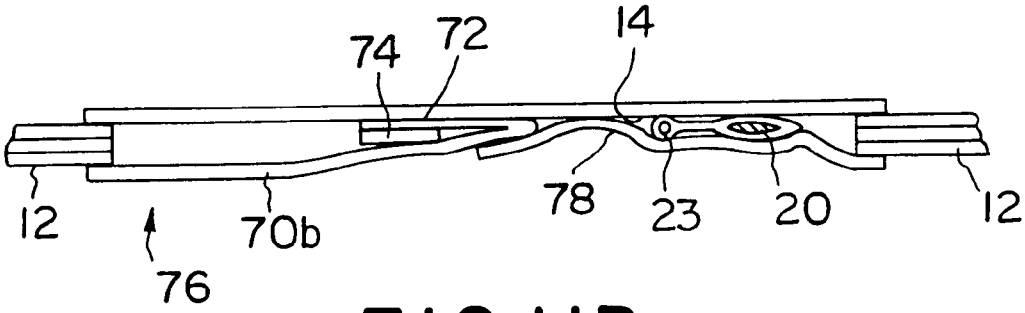
FIG. 11*b* illustrates another version of making the pod and trap.

In the embodiment of FIG. 11*b*, the pod construction of FIGS. 6–8 can for example be placed on the connecting strip 14 adjacent the trap 76 and a covering sheet 78 can be secured to and over the pod at an intermediate portion and the opposing free ends of the sheet 78 can be respectively connected to the trap 76 at one end and at the other end to an adjacent film unit 12. In this embodiment a portion of the trap mask 70 does not have to be sharply folded over the trap mask 70 so at to have some excess. The excess allows bonding thereto with diminished likelihood of the heat from the laminating step causing the trap material 74 being bonded to itself when in the folded condition.

Figure 13C:
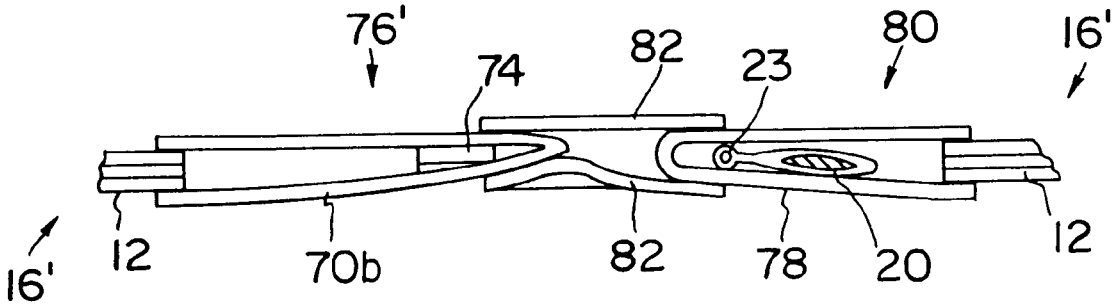
FIG. 13*c* illustrates in more detail the connection between the film units shown in FIG. 13*b*; and, FIGS. 14*a–c* illustrate still another method of making a trap in accordance with the present invention.
Figure 13A:
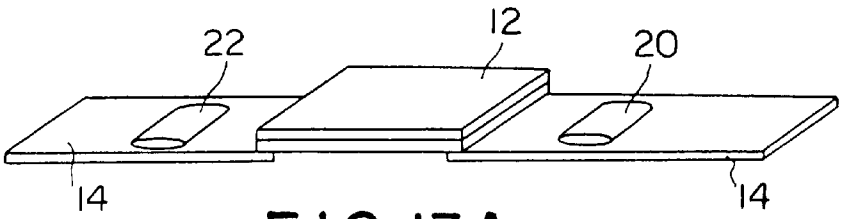
FIG. 13*a* illustrates a step in the manufacture of the film frame of FIG. 12.
Figure 12:
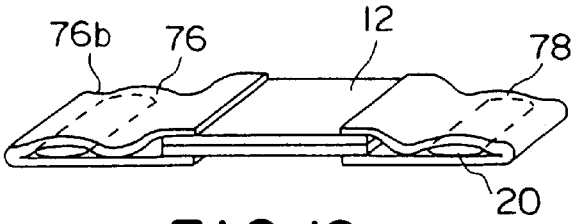
FIG. 12 illustrates a schematic version of a preassembled film unit.
Figure 13B:
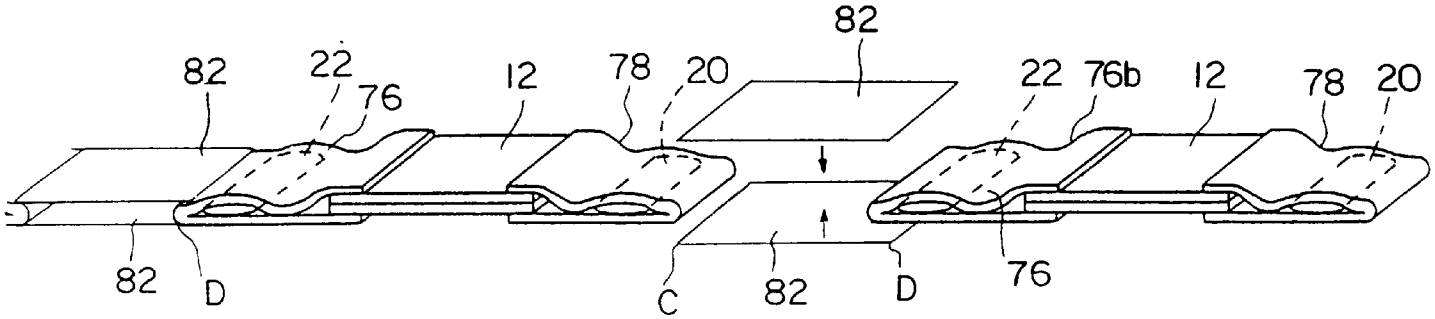
FIG. 13*b* illustrates a step in assembling a plurality of the film frames of FIG. 12.

In FIG. 13, there is illustrated another embodiment, wherein both the trap 76' and pod 80 can be foldable connected to the film unit 12, in the same manner as the trap 76 of the previous embodiments. Preliminarily, the pod and trap would be secured to a respective one of the connecting strips 14, as described with the formation of the trap 76 above. As seen in FIG. 13*b*, adjacent film frames 16' could then be connected in series by, for example, a pair of connecting strips 82. The connecting strips 82 can be made of the masking material and are bonded to opposite ends of the film frames; see FIG. 13*b*. The connecting strips 82 would be appropriately heat sealed to and between the film frames 16'. The connecting strips 82 would preferably have frangible sections (not shown) to facilitate separation of the frames as described above. Although the present embodiment, discloses that the connecting strips are made of masking material the present invention also envisions that the connecting strips 82 can be made of a variety of materials such as paper preferably with tear characteristics which are relatively easily controlled and therefore reliable. The film frames 16' as thus preassembled for interconnection with the other frames form an assemblage in which it is more likely to utilize most of the assembled frames on the strip. In this construction, there is an advantage in that if one of the film frames is not properly formed, then the film frames connected to the strip need not be considered wasted. Rather only the improperly formed or attached frame needs to be discarded and replaced.

Figure 14A:
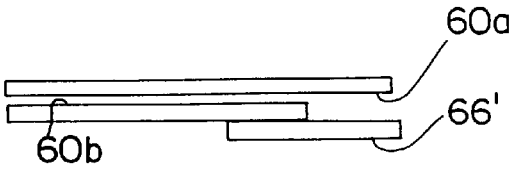
Figure 14B:
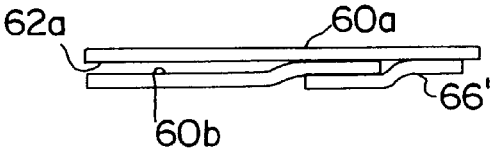
Figure 14C:
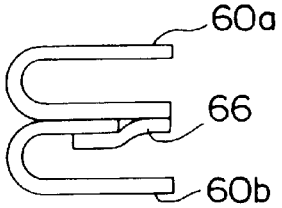

FIGS. 14*a–c* schematically represent various steps in the formation of another trap arrangement of the present invention. In this embodiment, the trap is double folded and strip 66' of trap material is secured as by lamination at the joint of two overlapping trap masks 60*a*, 60*b*. Thereafter the two masks 60*a*, 60*b* are folded as illustrated in FIG. 14*c*; whereby they may be able to secure top and bottom folds to respective ones of top and bottom connecting and covering sheets.

The foregoing preassembled self-contained frames can then be secured to preassembled pods and traps and connecting means. The use of the preassembled units is particularly advantageous in manufacturing schemes wherein, for example, manual labor is used; especially in a dark room setting. In this connection the preassembled frame units could be shipped as individual units along with preassembled pod, trap and connecting or cover sheets which are made ahead of time. Another method includes having the pod and trap assembled to a connecting strip ahead of time and then in the dark room assemble the film unit and then laminate a covering member over those components needing the covering sheet in order to arrive at an assembled film assemblage made in accordance with the present invention.

According to the present invention, the film frames can be formed with preassembled components or continuously. According to the present invention, the structures of the present invention and their methods of construction are highly versatile in that the film assemblage can have different constructions and yet still be able to be used in the same photographic apparatus for which the film assemblage is intended to operate with. This is advantageous over known approaches wherein a single film format is dedicated to the camera, whereby changes in the construction of the film and/or the method of fabricating such a film format would have a high likelihood of rendering such film unusable with the intended photographic device.

While there have been described what at present are considered to be the preferred embodiments of the present invention, it will be readily apparent to those skilled in the art that various changes may be made therein without departing from the invention, and it is intended in the claims to cover such changes and modifications as fall within the true spirit and scope of the invention.

What is claimed is:

1. An improved self-developing film unit comprising: processing fluid supply means including a rupturable reservoir of processing fluid at a leading end portion of the unit; image recording means of the self-developing type including first and second overlying layers one of which is exposable to form a latent photographic image, and spacer means connected to and between said first and second layers for providing a processing space therebetween for allowing processing fluid to pass therethrough; fluid trap means at a trailing end portion of the film unit for collecting excess processing fluid traveling through said processing space; first fluid-tight coupling means including a fluid passage for fluidically coupling said reservoir to a leading end of said processing space for allowing processing fluid from a ruptured reservoir to be introduced into said processing space and initiate processing of the latent image; and, second fluid-tight coupling means including a fluid passage for fluidically coupling a trailing end of said processing space with said trap means for allowing processing fluid to enter into said trap means; said first coupling means having one end portion sealably secured to an exterior surface of said reservoir and a second end portion sealably secured to an exterior surface of a leading end portion of said image recording means; and, said second coupling means having an end portion sealably secured to and about the trailing end portion of said image recording means and an opposite end portion sealably secured to an exterior surface of said trap means; said image recording means comprises a photosensitive layer, an image receiving layer in overlying and coextensive relationship to said photosensitive layer; said image receiving layer and said photosensitive layer being of the integral diffusion transfer type; and, said spacer means comprises a pair of spaced apart and generally parallel elongated rails coextensive with and adjacent opposed marginal edges of said layers; wherein each of said first and second fluid-tight coupling means is made of a pair of resiliently flexible sheets which are sealably joined together to define the respective fluid passages and which are made of a foldable and rollable material to thereby facilitate folding and unfolding thereof as well as permit rolling action of the fold during folding of the film unit.

2. The film unit of claim 1 wherein said trap means is enclosed by and between said pair of sheets of said second coupling means; said trap means includes a sheet of processing trap material extending generally transversely to a longitudinal extent of the film unit; and said processing trap material is made of a material which is permeable to air and traps the processing fluid.

3. The film unit of claim 1 further including braking means thereon protruding therefrom and associated with said reservoir for engaging a processing roller in an imaging apparatus, to thereby brake linear advancement of the film unit.

4. The film unit of claim 3 wherein said braking means includes a filament extending generally parallel to said reservoir and which is arranged to engage a processing roller.

5. The film unit of claim 2 wherein said trap means includes a generally a double folded arrangement comprising a first folded segment and a second folded segment, said first and second segments being joined together at a joint and a trap assembly bridging said first and second folded segments at said joint with distal end portions of said first and second segments being folded over and being sealably engageable with said second coupling means.

6. The film unit of claim 2 wherein said trap means includes a first flexible strip folded over wherein opposite ends thereof are sealably secured to the opposite layers of said image recording means and a trap assembly is located in a folded area.

7. The film unit of claim 1 including a plurality of the film units are interconnected together in longitudinally extending and end-to-end relationship to each other with a leading end portion of said reservoir of one film unit being juxtaposed to a trailing end portion of an adjacent film unit; and, means separably interconnecting leading and trailing end portions of each juxtaposed pair of film units, and allowing separation of the juxtaposed units in response to separation forces being applied to said separation means.

8. The film unit of claim 7 wherein said separable means includes an interconnecting sheet which at one end forms a portion of said first coupling means and at another portion forms a portion of said second coupling means.

9. A method of forming a film unit of the self-developing type comprising the steps of:

a) providing linearly spaced apart first and second sheets;

b) providing an image recording means of the self-developing type including first and second overlying and coextensive layers one of which is exposable to form a latent photographic image, and spacer means connected to and between the first and second layers for providing a processing space therebetween which allows processing fluid to pass therethrough to initiate processing of the latent image;

c) securing an outer surface of a leading edge portion of one of the layers of the image recording means to an internal surface of the first sheet and securing an outer surface of a trailing edge portion of the one layer to an internal surface of the second sheet;

d) securing rupturable reservoir to the internal surface of the first sheet at a location remote from a leading portion of the one layer;

e) securing processing fluid trap means to the internal surface of the second sheet at a location remote from a trailing portion of the one layer;

f) joining a third sheet in overlying relationship to the first sheet along the marginal edges thereof so as to encompass the reservoir and so that a trailing portion of the third sheet is secured sealably to an outer surface of a leading edge portion of the one layer of the image recording means; and, g) joining a fourth sheet in overlying relationship to the second sheet along the marginal edges thereof so as to encompass the trap means and so that a leading portion of the fourth sheet is secured sealably to an outer surface of a trailing edge portion of the other layer of the image recording means, whereby a fluid passage is formed between the rupturable means and the processing space as well as a fluid passage is formed between the processing space and the trap means; and, further including the step of securing a braking means on a surface of one the joined pairs of sheets whereby the braking means is engageable to strike a processing roller in an imaging apparatus to arrest linear movement of the film unit; said step of securing the braking means includes securing the braking means adjacent the pod so that the braking means initially engages the stop and not the pod; thereby lessening any likelihood of premature pod rupture.

* * * * *